US006800820B1

(12) United States Patent
Liu et al.

(10) Patent No.: US 6,800,820 B1
(45) Date of Patent: Oct. 5, 2004

(54) MESOSCALE MEMS SWITCH APPARATUS AND METHOD

(75) Inventors: Junhua Liu, Palatine, IL (US); William Olson, Lake Villa, IL (US)

(73) Assignee: Motorola, Inc., Schaumburg, IL (US)

( * ) Notice: Subject to any disclaimer, the term of this patent is extended or adjusted under 35 U.S.C. 154(b) by 69 days.

(21) Appl. No.: 10/411,490

(22) Filed: Apr. 10, 2003

(51) Int. Cl.[7] ..... H01H 57/00
(52) U.S. Cl. ..... 200/181
(58) Field of Search ..... 200/181

(56) References Cited

U.S. PATENT DOCUMENTS 6,162,230 A * 12/2000 Polla et al. ..... 606/107
6,307,169 B1 * 10/2001 Sun et al. ..... 200/181

OTHER PUBLICATIONS

Gabriel M. Rebeiz and Jeremy B. Muldavin, "RF MEMS Switches and Switch Circuits," IEEE Microwave Magazine, ISSN 1527–3342/01, Copyright 2001 IEEE, Dec., pp. 59–71.

MPD Microwave Product Digest, "RF to Light", Sep. 2002, Circle Reader Service Nos. 1, 3, and 202.

"MEMS RF Switch And Relay Solutions", Teravicta Technologies, Inc., Copyright 2002, printed from the Teravicta website at http://www.teravicta.com, Homepage and Products (2 pages).

Product Brochure, Hittite Microwave Corporation, "GaAs Switches," undated, 1 page.

* cited by examiner

*Primary Examiner*—Ramon M. Barrera

(57) ABSTRACT

A plurality of mesoscale MEMS switches each share a common control voltage potential electrode (such as ground). So configured, a large number of switches can be provided without incurring a significant increase in required actuation voltage. Such switches can be inter-coupled in a variety of ways. In addition, in one embodiment, stacked switches can be provided. If desired, such stacked switches can share a common movable conductive switch element.

22 Claims, 3 Drawing Sheets

MESOSCALE MEMS SWITCH APPARATUS AND METHOD

TECHNICAL FIELD

This invention relates generally to mesoscale structures and micro-electromechanical systems ("MEMS").

BACKGROUND

Semiconductor-based switches are known in the art. Though effective when serving as, for example, a single-pole double-throw switch, a typical gallium arsenide switch tends to be relatively costly. Depending upon complexity and other design requirements, such switches can range upwardly in cost from approximately U.S. $0.50 to nearly U.S. $10.00.

MEMS devices and apparatus are also known in the art. Much work (though few commercial breakthroughs) has been directed at small (a very few microns) systems that typically use semiconductor materials and processing techniques. Though such technology may eventually yield commercially feasible switches at a satisfactory price point, at present, commercially useful devices based upon such technology tend either to be relatively expensive and/or unavailable.

It has also recently been proposed that printed wiring board fabrication techniques could be utilized to realize mesoscale MEMS structures (having overall dimensions on the order of, for example, ten to a few hundreds mils). For example, U.S. application Ser. No. 09/929,750 as filed on Aug. 14, 2001 by the same assignee as this application describes a Micro-Electro Mechanical System that can be fabricated within the context of a printed wiring board using high density interconnect substrate technology (the contents of which reference are incorporated herein). Further, such an approach has also been shown to be useful and effective to facilitate construction and provision of a mesoscale MEMS electrostatic switch (see in particular U.S. application Ser. No. 10/133,913 as filed on Apr. 26, 2002 by the same assignee as this application and which discloses a Micro Electro-Mechanical System and Method, the contents of which are hereby incorporated by this reference).

Unfortunately, while such mesoscale MEMS structures hold out the promise of considerably less expensive alternatives to semiconductor switches, to date, it has not been demonstrated that more complicated switch structures can be effectively fabricated and fielded using such methodologies. For example, cost-effective and commercially useful multiple-pole and/or multiple-throw switches are not available in practice or theory, with actuation voltage concerns presenting at least one significant challenge. For example, at least some prior art suggestions for multiple-throw mesoscale MEMS switches requires an ever-increasing actuation voltage with each increase in the throw count (that is, actuation voltage for a SP3T switch of this type is considerably higher than for a SP2T switch of the same type).

BRIEF DESCRIPTION OF THE DRAWINGS

The above needs are at least partially met through provision of the mesoscale MEMS switch apparatus and method described in the following detailed description, particularly when studied in conjunction with the drawings, wherein.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are typically not depicted in order to facilitate a less obstructed view of these various embodiments of the present invention.

DETAILED DESCRIPTION

Generally speaking, pursuant to these various embodiments, a plurality of mesoscale MEMS switches that each include at least a first and a second control voltage potential electrode each have one of those control voltage potential electrodes coupled in common. For example, the grounded control voltage potential electrode of each mesoscale MEMS switch can all be coupled together. In a preferred embodiment, such electrodes are generally commonly joined at a substantially central location such that, the switches are disposed outwardly therefrom. In one embodiment, the switches are disposed substantially symmetrically about this substantially central location.

In one embodiment, such switches are disposed substantially coplanar to one another. In another embodiment, some switches can be disposed on a different plane. So configured, at least one of the switches on the first plane and another switch on the second plane can share a common movable conductive switch element. Such an embodiment permits a wide variety of resultant switch architectures, including a switch having any of three possible states (for example, when the common movable conductive switch element closes the switch electrodes of the switch in the first plane, when the common movable conductive switch element closes the switch electrodes of the switch in the second plane, and when the common movable conductive switch element closes neither of these switches).

Such mesoscale MEMS switches, whether formed in a single plane or with multiple planes, can be configured in a wide variety of ways, including virtually any conceivable multiple-throw and/or multiple-pole configuration. In addition, switch inputs and/or switch outputs can be readily shared in a variety of ways to accommodate a wide variety of multiple input, multiple output, and switch redundancy architectures and requirements.

Figure 1:
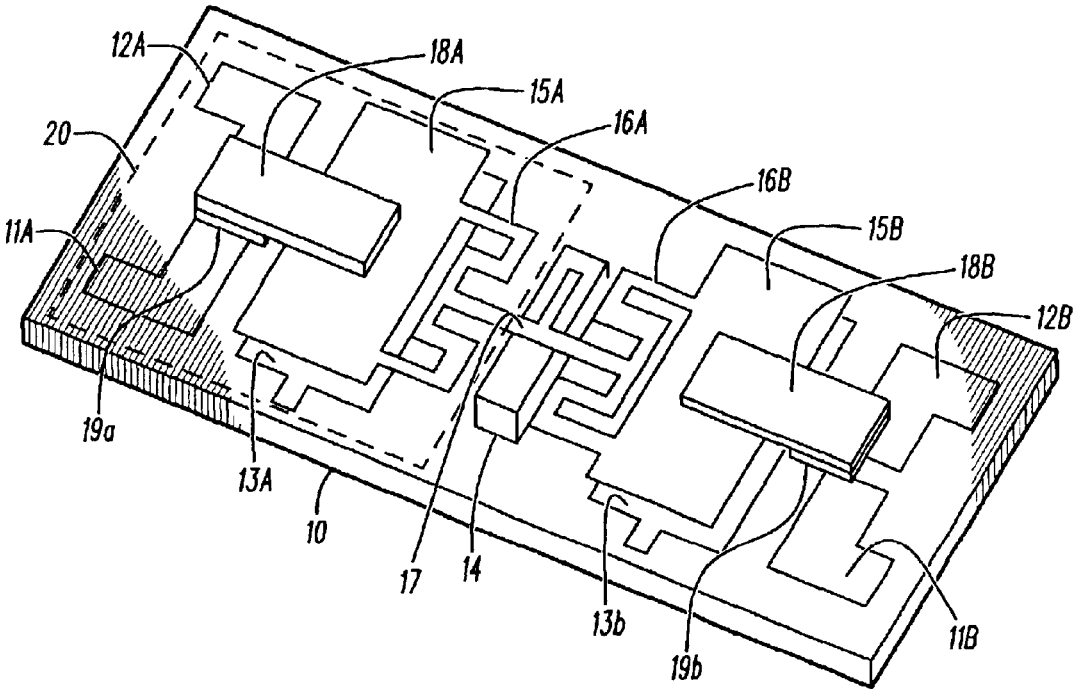
FIG. 1 comprises a perspective view of a two-switch structure as configured in accordance with an embodiment of the invention.

Referring now to the drawings, and in particular to FIG. 1, an illustrative two-switch device will be described. In a preferred embodiment, a substrate 10 comprised of a standard printed wiring board as well understood in the art supports a variety of conductive and insulating layers as are formed through a series of depositions and etchings. In this embodiment, a first switch 20 includes an input electrode 11A and an output electrode 12A. (In this illustration, the second switch includes the same elements as the first switch 20, and hence will not be separately described. Nevertheless, for the convenience of the reader, corresponding elements in the second switch are denoted with the identifying letter "B" as appended to the relevant corresponding reference numeral.) Such electrodes 11A and 12A can be formed either through deposition of an appropriate conductor such as copper or by etching away portions of a copper layer as was originally laminated onto the surface of the substrate 10. In this embodiment, the input and output electrodes 11A and 12A are disposed and formed such that a gap separates the two electrodes. As will be shown below this gap can be selectively bridged by a cantilevered member to effect a switch closure.

Another conductive surface on the substrate 10 comprises a control voltage potential electrode 13A. As will be shown below, this control voltage potential electrode 13A can be used to cause selective movement of the cantilevered member mentioned above. The substrate 10 also supports a post 14 comprised of insulating material (such as, for example, hexamethylene-1,6-diisocyanate, otherwise known as HMI-polymer).

A cantilevered beam 16A (comprised in a preferred embodiment of a conductive material such as copper that is formed in a serpentine shape) is attached at one end to the post 14. If desired, the cantilevered beam 16A can include, at least in part, insulator material as well. In general, however, conductive material alone will more likely provide a preferable degree of resilience and elasticity. The cantilevered beam 16A couples at the opposing end to a conductive pad 15A. This conductive pad 15A and the conductive cantilevered beam 16A together comprise a second control voltage potential electrode for this switch 20. In a preferred embodiment, this second control voltage potential electrode is coupled to ground such that the conductive pad 15A will be attracted towards the first control voltage potential electrode 13A on the substrate 10 surface when the later is provided with a positive control voltage potential (if desired, of course, the polarity of this arrangement can be reversed). The resiliency of the cantilevered beam 16A is sufficiently weak to permit the conductive pad 15A to move towards the first control voltage potential electrode 13A while still being resilient enough to permit the conductive pad 15A to return to its original position when the former is not energized.

In this embodiment, another beam 18A comprised of an insulating material is attached to the conductive pad 15A and extends outwardly over the input and output electrodes 11A and 11B. A conductive surface 19A is disposed on the underside of this beam 18A. So configured, when the second control voltage potential electrode (comprising in particular the conductive pad 15A) is drawn towards the first control voltage potential electrode 13A, the conductive surface 19A on the beam 18A comes into contact with both the input and the output electrode 11A and 12A and thereby serves to electrically couple the one to the other.

In a preferred embodiment, a second switch is formed such that it's second control voltage potential electrode 16B and 15B is joined 17 with the second control voltage potential electrode 16A and 15A of the first switch 20. This joinder 17 occurs, in this embodiment, atop the post 14. So configured, both switches can share, for example, a ground potential or some other non-ground potential as may be desired or appropriate to a given application.

As noted earlier, these MEMS-based switches can be formed using mesoscale printed wiring board fabrication techniques such as those disclosed and taught in the earlier cited references. Accordingly, in a relatively ordinary embodiment, these switches would each have a length of from about 50 to 150 mils, though somewhat smaller and certainly larger dimensions could be accommodated if desired. These sizes are, of course, larger than those that semiconductor fabrication techniques can achieve. These mesoscale MEMS switches, however, are considerably less expensive than a semiconductor-based counterpart and, for many applications, the increased size presents no issue or concern.

Figure 2:
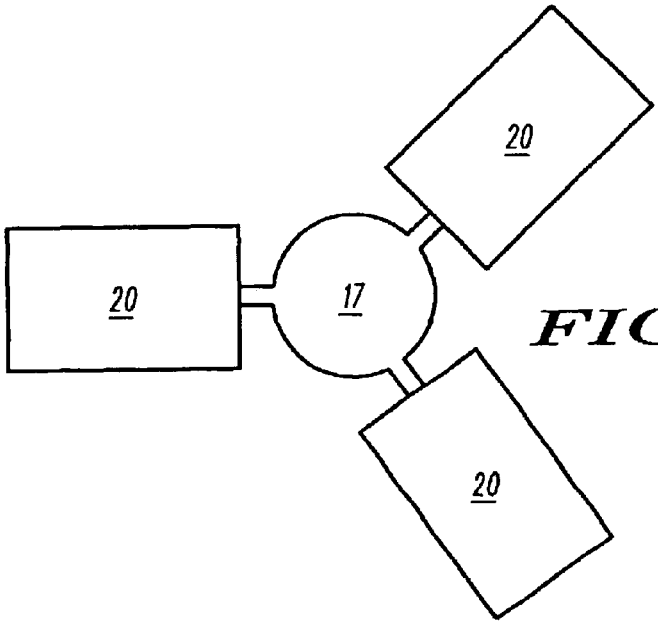
FIG. 2 comprises a top plan block diagram view of a three-switch structure as configured in accordance with an embodiment of the invention.
Figure 3:
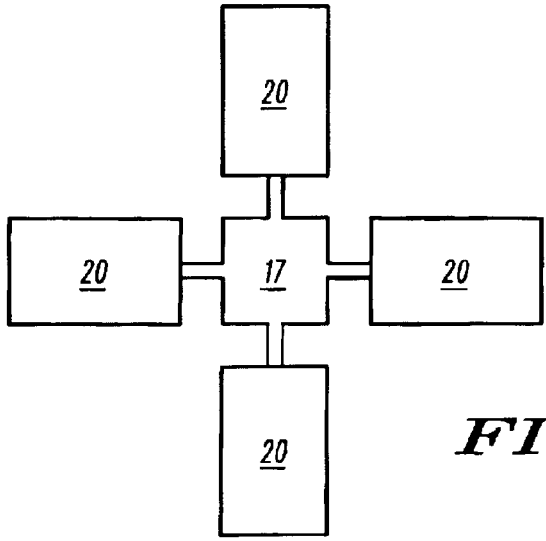
FIG. 3 comprises a top plan block diagram view of a four-switch structure as configured in accordance with an embodiment of the invention.
Figure 4:
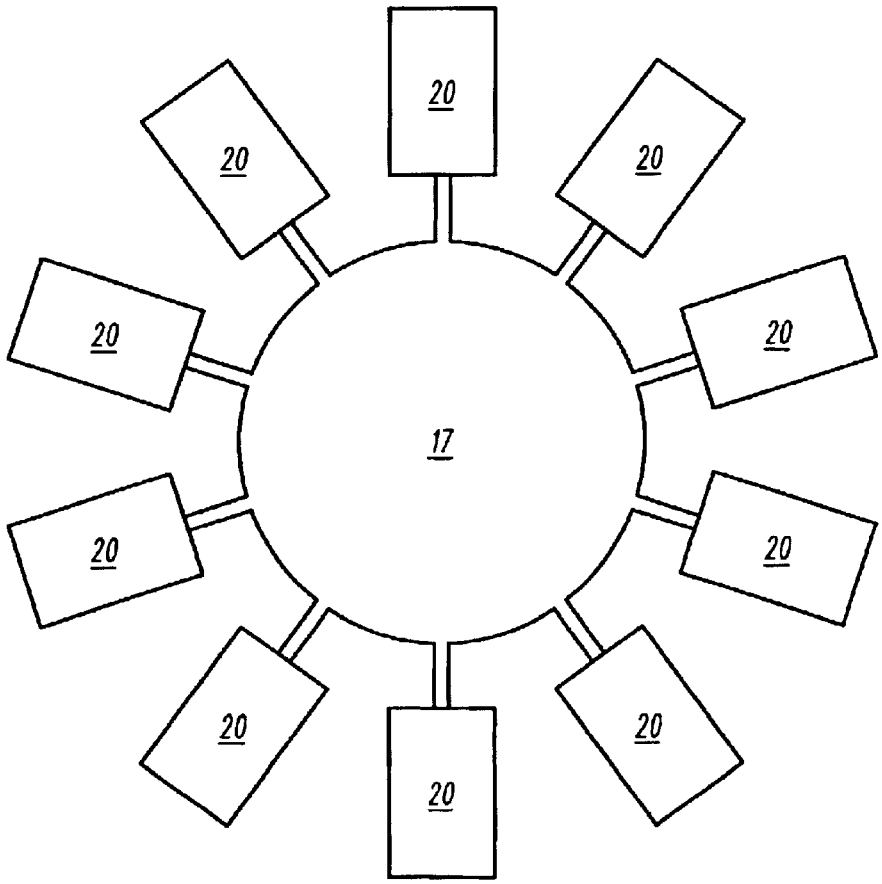
FIG. 4 comprises a top plan block diagram view of a ten-switch structure as configured in accordance with an embodiment of the invention.

And, unlike many other earlier mesoscale MEMS-based switches, these switches will typically function properly using an actuation voltage of no more than about thirty volts essentially regardless of how many additional switches are added in the same shared control voltage potential electrode fashion (assuming that the cantilevered beam 16A has an overall stiffness constant of no more than 3.10 N/m and that the gap between the control voltage potential electrodes 13A and 15A is about 1 mil, these specifications being readily achievable with present mesoscale printed wiring board fabrication techniques). For example, one can provide three such switches 20 (see FIG. 2), four such switches 20 (see FIG. 3), ten such switches 20 (see FIG. 4), or more without necessitating any significant increase of the actuation voltage. Again, these benefits accrue in significant measure due to the use of a conductive pad that is shared by the switches 20 to couple their selected common control electrodes together.

The embodiments depicted in FIGS. 1 through 4 all present the switches 20 as being substantially symmetrically disposed about the shared conductive pad. If desired, of course, an asymmetrical configuration can be adopted. These embodiments also present the switches 20 as all being substantially coplanar to one another. As will be shown below, it is also possible to accommodate and benefit from a non-coplanar distribution of at least some of the switches 20.

Figure 5:
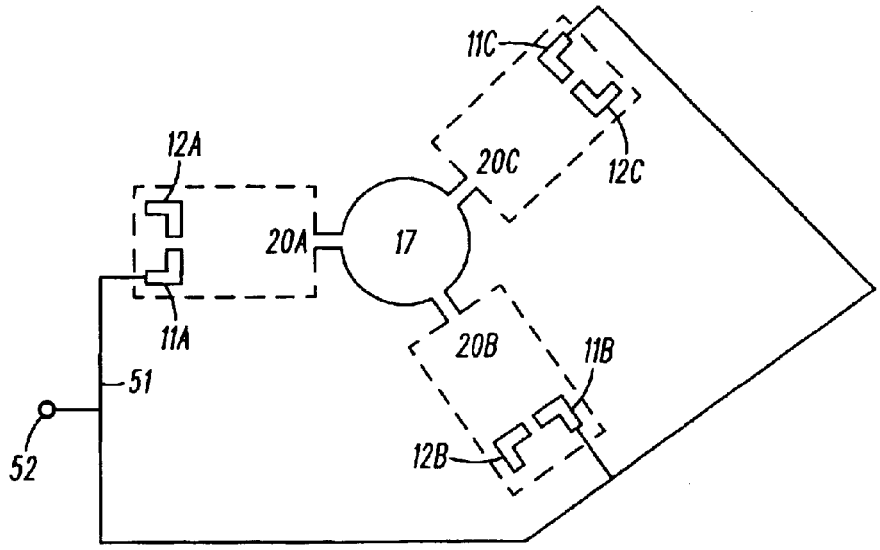
FIG. 5 comprises a top plan block diagram view of a three-switch structure as configured in accordance with yet another embodiment of the invention.

As already indicated, a large number of switches can be provided as described above. Such an array can then be coupled and/or inter-coupled in a wide variety of ways to serve a significant number of purposes and applications. To illustrate, and referring now to FIG. 5, the input electrode 11A, 11B, and 11C of three different switches 20A, 20B, and 20C can be electrically coupled with an appropriate electrical conductor 51 (such as a conductive trace as formed on the substrate 10 described earlier). So configured, a single input 52 can yield a plurality of outputs (with a discrete output being provided by each switch). Such a configuration can be used, for example, to effect a one-to-many circuit requirement. As another illustration, if the coupled electrodes 11A, 11B, and 11C are output electrodes rather than input electrodes, then a many-to-one circuit requirement can be readily met. As yet another illustration, if the remaining input/output electrodes are similarly electrically joined together, then a switch having plural redundancy can be provided. Of course, other configurations are possible as well, by inter-coupling varying numbers of input and output electrodes with one another to achieve a particular desired architecture.

Figure 6:
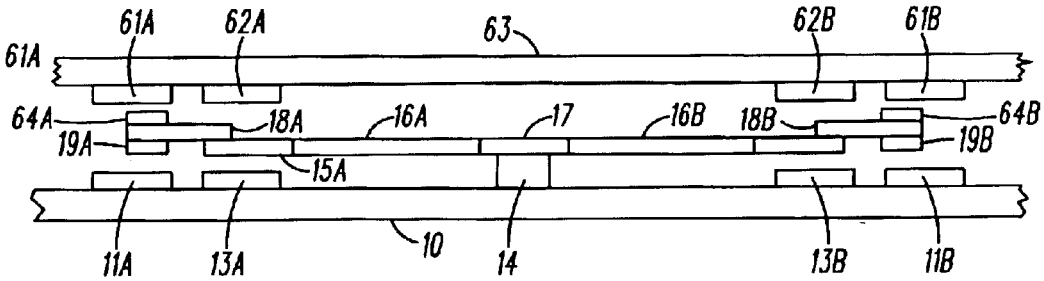
FIG. 6 comprises a side-elevational view of a four-switch structure as configured in accordance with yet another embodiment of the invention.

As alluded to above, it is also possible to provide a mesoscale MEMS multi-switch structure having at least some switches that are disposed other than coplanar with one another. To now illustrate this concept, and referring to FIG. 6, a first pair of switches can be seen as described above wherein these two switches are disposed substantially coplanar to one another. In this embodiment, however, an additional pair of switches are formed on a second substrate 63 with input/output electrodes (61A and 61B being visible in this view) and control voltage potential electrodes 62A and 62B being vertically displaced (but with at least the control voltage potential electrodes not being substantially horizontally displaced) with respect to their counterpart components in the first two switches. (Note: Since area size is proportional to the electrostatic force required to actuate such a switch, the actual size of the control voltage potential electrodes denoted by reference numerals 13A, 13B, 62A, and 62B would likely be considerably larger relative to the other illustrated components than as is shown in FIG. 6. These electrodes are rendered in a smaller relative size here for the sake of clarity.)

So configured, each pair of upper and lower switches share a common movable conductive switch element, in this case the cantilevered (and shared) control voltage potential electrode 16A and 16B, respectively. By disposing a conductive surface 64A and 64B on the beam 18A and 18B such that this conductive surface 64A and 64B can electrically bridge the gap between the input and output electrodes of the upper switches when the beam is biased towards the upper switches by an appropriate application of control voltage potential, any number of useful configurations become possible.

For example, a three-position switch can be readily provided, with a first position occurring when the cantilevered beam is urged downwardly towards the lower switch input/output electrodes, a second position occurring when the cantilevered beam is urged upwards towards the upper switch input/output electrodes, and a third position as shown where the cantilevered beam is not being urged in either direction.

Figure 7:
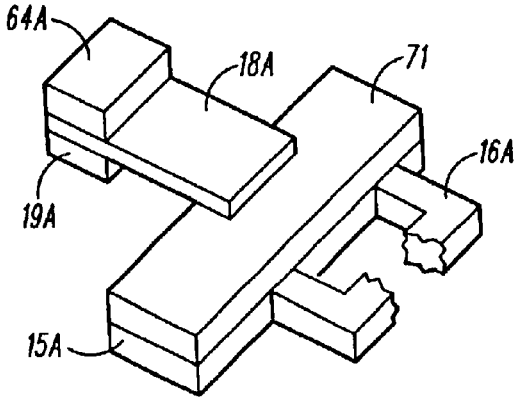
FIG. 7 comprises a perspective detail view of a portion of a switch as configured in accordance with yet another embodiment of the invention.

As depicted, it can be seen that the conductive plate 15 (or 15A) of the control voltage potential electrode is somewhat more distant from the control surface 62A of the upper switch than from the control surface 13A of the lower switch. This configuration can work, but it may necessitate a higher actuation voltage when utilizing the upper switch. Therefore, and referring now to FIG. 7, it may be desirable to add additional conductive material 71 such that the distance becomes substantially equal for both switches. (Another approach might be to increase the thickness of the control voltage potential electrode to reduce the size of the capacitive gap.)

It can therefore be seen that a first plurality of mesoscale MEMS switches can be formed and disposed substantially coplanar with respect to one another with a conductive surface that is electrically coupled to a control electrode of each of the plurality of mesoscale MEMS switches. Depending upon the embodiment, this control electrode can comprise either a ground potential control electrode or a non-ground voltage potential control electrode. In addition, if desired, a second mesoscale MEMS switch (or a plurality thereof) can be formed and disposed substantially non-coplanar with respect to the first plurality. The input and output electrodes for all these switches can be coupled and/or inter-coupled as desired to effect a wide variety of switches, including virtually any desired multiple-pole multiple-throw switch that may be usefully conceived. It is also possible to configure such multiple pluralities of switches such that at least some switches can share a movable conductive switch element. In each case, such multiplicity can be achieved using mesoscale MEMS fabrication techniques without causing a concurrent significant increase in the actuation voltage that is required to operate the resultant switches.

Those skilled in the art will recognize that a wide variety of modifications, alterations, and combinations can be made with respect to the above-described embodiments without departing from the spirit and scope of the invention, and that such modifications, alterations, and combinations are to be viewed as being within the ambit of the inventive concept.

We claim:

1. A mesoscale MEMS switch apparatus comprising a least a first and second mesoscale MEMS switch, wherein both the first and second mesoscale MEMS switch each includes a first and second control voltage potential electrode, and further comprising coupled electrodes comprising at least one of the first and second control voltage potential electrodes for the first mesoscale MEMS switch that is electrically coupled to a similar corresponding electrode of the second mesoscale MEMS switch, and further comprising at least a third mesoscale MEMS switch, wherein the third mesoscale MEMS switch includes a first and second control voltage potential electrode, and wherein a similar corresponding one of the first and second control voltage potential electrode for the third mesoscale MEMS switch is electrically coupled to the coupled electrodes.

2. The mesoscale MEMS switch apparatus of claim 1 wherein the first control voltage potential electrode comprises a ground potential electrode and wherein the first control voltage potential electrode of the first mesoscale MEMS switch is electrically coupled to the similar corresponding electrode, the first control voltage potential electrode, of the second mesoscale MEMS switch.

3. The mesoscale MEMS switch apparatus of claim 1 wherein a shared conductive pad serves to couple the coupled electrodes.

4. The mesoscale MEMS switch apparatus of claim 3 wherein the first and second mesoscale MEMS switches are disposed substantially symmetrically about the shared conductive pad.

5. The mesoscale MEMS switch apparatus of claim 1 wherein the first and second mesoscale MEMS switches are disposed substantially coplanar with respect to one another.

6. The mesoscale MEMS switch apparatus of claim 5 wherein the third mesoscale MEMS switch is disposed non-planar with respect to the first and second mesoscale MEMS switches.

7. The mesoscale MEMS switch apparatus of claim 6 wherein the first and third mesoscale MEMS switches share a common movable conductive switch element.

8. The mesoscale MEMS switch apparatus of claim 1 wherein each of the first and second mesoscale MEMS switches includes an input electrode.

9. The mesoscale MEMS switch apparatus of claim 8 wherein the input electrodes for the first and second mesoscale MEMS switches are electrically coupled together.

10. The mesoscale MEMS switch apparatus of claim 9 wherein the output electrodes for the first and second mesoscale MEMS switches are electrically coupled together.

11. The mesoscale MEMS switch apparatus of claim 1 wherein each of the first and second mesoscale MEMS switches includes an output electrode.

12. A method comprising:

providing a first mesoscale MEMS switch having first and second control voltage potential electrodes;

providing a second mesoscale MEMS switch having first and second control voltage potential electrodes;

providing a third mesoscale MEMS switch having first and second control voltage potential electrodes, wherein at least one of the following arrangements is provided:

the first control voltage potential electrode of the first mesoscale MEMS switch is electrically coupled to the first control voltage potential electrode of the second mesoscale MEMS switch;

the second control voltage potential electrode of the first mesoscale MEMS switch is electrically coupled to the second control voltage potential electrode of the second mesoscale MEMS switch.

13. The method of claim 12 wherein providing a third mesoscale MEMS switch includes providing the third mesoscale MEMS switch on a plane that is substantially non-co-planar with the first and second mesoscale MEMS switches.

14. The method of claim 13 and further comprising:

providing a movable conductive switching element that is shared by the third mesoscale MEMS switch and at least one of the first and second mesoscale MEMS switches.

15. The method of claim 12 wherein:

when the first control voltage potential electrode of the first mesoscale MEMS switch is electrically coupled to the first control voltage potential electrode of the second mesoscale MEMS switch, the first control voltage potential electrode of the third mesoscale MEMS switch is also electrically coupled to the first control voltage potential electrode of the first mesoscale MEMS switch; and when the second control voltage potential electrode of the first mesoscale MEMS switch is electrically coupled to the second control voltage potential electrode of the second mesoscale MEMS switch, the second control voltage potential electrode of the third mesoscale MEMS switch is also electrically coupled to the second control voltage potential electrode of the first mesoscale MEMS switch.

16. The method of claim 12 wherein providing a first and second mesoscale MEMS switch includes disposing the first and second mesoscale MEMS switches substantially symmetrically about a conductive post.

17. An apparatus comprising:

a first plurality of at least five mesoscale MEMS switches disposed substantially co-planar with respect to one another, a conductive surface that is electrically coupled to a control electrode of each of the plurality of mesoscale MEMS switches.

18. The apparatus of claim 17 wherein the control electrode comprises a ground potential control electrode.

19. The apparatus of claim 17 wherein the control electrode comprises a non-ground voltage potential control electrode.

20. The apparatus of claim 17 and further comprising a second plurality of mesoscale MEMS switches that are disposed substantially co-planar with respect to one another but not with the first plurality of mesoscale MEMS switches.

21. The apparatus of claim 20 and further comprising at least one movable conductive switch element, which movable conductive switch element is shared by at least one mesoscale MEMS switch of both the first and second plurality of mesoscale MEMS switches.

22. The apparatus of claim 21 wherein at least one mesoscale MEMS switch of both the first and second plurality of mesoscale MEMS switches and the movable conductive switch element comprises a three-position switch.

* * * * *